US007686074B2

(12) United States Patent
McCoy et al.

(10) Patent No.: US 7,686,074 B2
(45) Date of Patent: Mar. 30, 2010

(54) APPARATUS AND METHOD FOR ACTIVE CIRCUIT PROTECTION OF DOWNHOLE ELECTRICAL SUBMERSIBLE PUMP MONITORING GAUGES

(75) Inventors: Robert H. McCoy, Talala, OK (US); James E. Layton, Chelsea, OK (US); Larry J. Parmeter, Broken Arrow, OK (US); Gordon Besser, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 73 days.

(21) Appl. No.: 12/033,819

(22) Filed: Feb. 19, 2008

(65) Prior Publication Data

US 2008/0196887 A1 Aug. 21, 2008

Related U.S. Application Data

(60) Provisional application No. 60/902,313, filed on Feb. 20, 2007.

(51) Int. Cl.

| | |
|---|---|
| ***E21B 4/04*** | (2006.01) |
| ***E21B 43/00*** | (2006.01) |
| ***H02H 7/09*** | (2006.01) |
| ***F04B 49/06*** | (2006.01) |

(52) U.S. Cl. ..... 166/66.4; 166/68; 166/105; 417/44.11; 417/423.3; 361/33

(58) Field of Classification Search ..... 166/105, 166/66.4, 68; 417/423.3, 423.7, 44.1, 44.11; 361/30, 31, 33

See application file for complete search history.

(56) References Cited

U.S. PATENT DOCUMENTS

| | | | | |
|---|---|---|---|---|
| 2,972,708 | A * | 2/1961 | Schaefer | 361/28 |
| 4,178,579 | A * | 12/1979 | McGibbeny et al. | 340/853.3 |
| 4,492,523 | A * | 1/1985 | Knox | 417/13 |
| 4,581,613 | A | 4/1986 | Ward et al. | |
| 5,515,038 | A | 5/1996 | Smith | |
| 5,819,848 | A * | 10/1998 | Rasmuson et al. | 166/250.15 |
| 6,112,808 | A * | 9/2000 | Isted | 166/60 |
| 6,361,272 | B1 | 3/2002 | Bassett | |

* cited by examiner

*Primary Examiner*—Kenneth Thompson
(74) *Attorney, Agent, or Firm*—Bracewell & Giuliani LLP

(57) ABSTRACT

Embodiments of the present invention beneficially provide circuits and methods which isolate downhole electronics of a well pump assembly from a power surge. The pump assembly includes a motor and a housing, including head, base, and manifold plate. The head has a hollow interior and a shoulder. The head is mounted to the motor so that, in operation, oil from the motor fills the interior of the head. The base has an outside diameter to fit snugly inside the head. The manifold plate is located between an upper end of the base and the shoulder of the head so that the axis of the manifold plate is perpendicular to the axis of housing. A gauge circuit and an isolation circuit are mounted to the manifold plate. The isolation circuit includes active semiconductor elements to detect excessive voltage and to protect the gauge circuit from the excessive voltage.

17 Claims, 6 Drawing Sheets

APPARATUS AND METHOD FOR ACTIVE CIRCUIT PROTECTION OF DOWNHOLE ELECTRICAL SUBMERSIBLE PUMP MONITORING GAUGES

RELATED APPLICATIONS

This application claims priority to U.S. Provisional Patent Application No. 60/902,313, titled System and Method for Active Circuit Protection of Downhole Electrical Submersible Pump Monitoring Gauges, filed on Feb. 20, 2007.

BACKGROUND

1. Field of the Invention

This invention relates in general to downhole electrical submersible pump ("ESP") electronics and, in particular, to downhole ESP assemblies which utilize active semiconductor circuitry to disconnect or regulate voltage to downhole electronics for protection in the event of a power surge or grounded phase.

2. Description of the Prior Art

In conventional submersible pump installations, there may be a system for monitoring various characteristics of the pump motor environment, such as pressure, vibration, and temperature. Due to the extreme conditions inside a well, it is important to be continuously aware of these downhole operating characteristics. The temperature is often 200° F. or higher, while the voltage and current being supplied is also at high levels.

There are various methods used to monitor downhole operating characteristics. A surface unit typically monitors these and other conditions via data sent from a downhole unit. For example, the temperature of the motor provides an indication of the pump's operating efficiency. As such, a temperature probe located within the motor can provide an indication of whether or not the motor is overheating, which may possibly lead to motor failure.

Submersible pump installations include a large horsepower electric motor located in the well. The electric motor receives three-phase AC power via a power cable extending from the surface with voltages phase-to-phase being commonly 480 volts or more. The electric motor drives a pump, of varying types, to pump well fluid to the surface. The downhole gauge is used to monitor the downhole characteristics. The gauge is in a housing connected to the bottom of the motor. The gauge is coupled to the neutral node or Y point of the three-phase power windings of the motor via an inductor of very large inductance. The large inductor is used to filter out the motor AC in order to prevent the AC from interfering with communication signals transmitted between the downhole unit and surface unit. The large inductors also work to protect the gauge from voltage surges caused by varying phenomena, such as when one phase of the three phase power becomes grounded, which results in a high voltage at the three phase "Y" point of the motor.

This prior art approach has numerous disadvantages. For example, the inductors are large and very expensive. Also, the high inductance and capacitance values of the protection circuitry restrict the communications bandwidth through the protection circuitry. In addition, the inductors create a large leakage current to ground as the output is typically limited with a zener diode, which can cause corrosion in cases of higher voltages.

SUMMARY OF THE INVENTION

In view of the foregoing, embodiments of the present invention beneficially provide circuits and methods which isolate downhole electronics in the event of a power surge on the system. Embodiments of the circuitry and methods of the present invention advantageously provide isolation circuitry consisting of semiconductor components mounted inside a housing located downhole in an electrical submersible pump assembly which includes, for example, a pump, motor, and gauge component. The isolation circuit is coupled to a gauge processor which measures and tests various downhole characteristics such as temperature, pressure, and vibrations. In the event of a power surge on the system, the isolation circuit will cease or limit electrical conduction, thereby protecting the sensitive gauge electronics. As such, the isolation circuitry of the present invention replaces the large expensive chokes utilized in the prior art.

Embodiments of the present invention also provide a gauge circuit which utilizes a switching regulator or constant current as an internal control circuit for stabilizing the voltage and current of the gauge circuit. There can be multiple sensors in the downhole housing, including for example, a vibration sensor mounted within the downhole housing on an axis perpendicular to the axis of the downhole housing.

Embodiments of the present invention provide a well pump assembly. The pump assembly includes a motor and a housing, including a head, a base, and a manifold plate. The head has a hollow interior and a shoulder. The head is mounted to the motor so that, in operation, oil from the motor fills the interior of the head. The base has an outside diameter to fit snugly inside the head. The manifold plate is located between an upper end of the base and the shoulder of the head so that the axis of the manifold plate is perpendicular to the axis of housing. A gauge circuit is mounted to the lower surface of the manifold plate. Mounting the gauge circuit to the manifold plate, which is perpendicular to the axis of housing, allows, for example, vibration sensors advantageously to detect vibrations in the plane perpendicular to the axis of housing. In addition, an isolation circuit is attached to the upper surface of the manifold plate so that the isolation circuit is mounted inside the interior of the head, and the manifold plate separates the isolation circuit from the gauge circuit. The isolation circuit includes active semiconductor elements to detect excessive voltage and to protect the gauge circuit from the excessive voltage.

In view of the foregoing, the present invention provides isolation circuitry and methods to protect sensitive downhole electronics in an electrical submersible pump assembly by utilizing semiconductor technology to provide a more compact, faster, cheaper, and efficient pump assembly.

BRIEF DESCRIPTION OF THE DRAWINGS

Some of the features and benefits of the present invention having been stated, others will become apparent as the description proceeds when taken in conjunction with the accompanying drawings, in which.

DETAILED DESCRIPTION OF THE INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
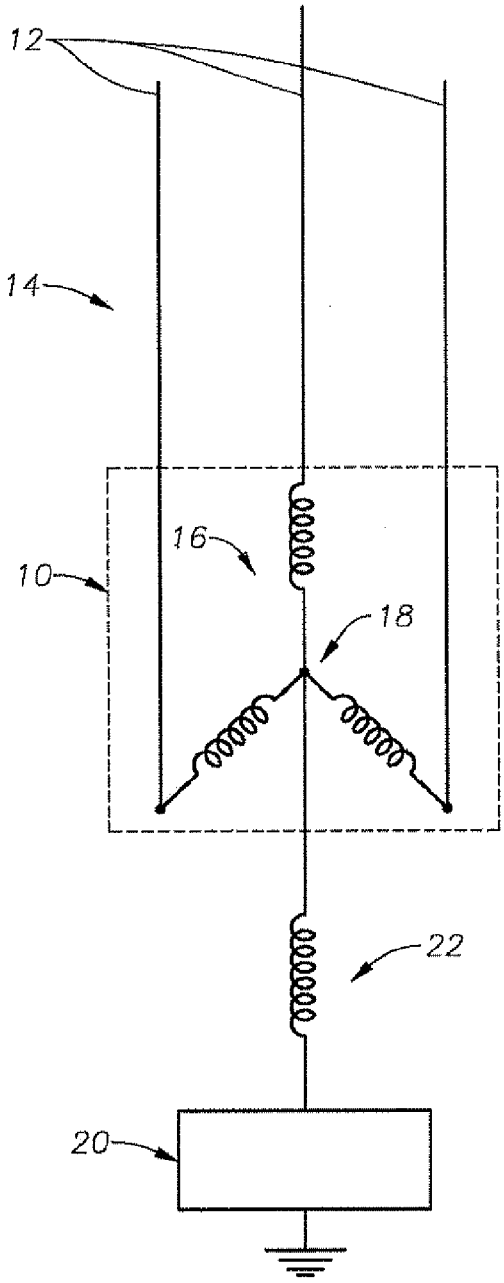
Fig. 1 (Prior Art)
FIG. 1 is a block diagram of an electrical submersible pump assembly in accordance with the prior art.

Referring to FIG. 1, an exemplary embodiment of a prior art electrical submersible pump installation is illustrated. A pump motor assembly 10 is connected to a three-phase power source (not shown) by means of three conductors 12 located inside power cable 14. Power cable 14 extends downhole from the surface to pump motor assembly 10. The entire submersible pump installation of FIG. 1 is located downhole inside a standard well casing. Motor assembly 10 is symbolically shown by a three-phase power AC winding 16, which is Y connected and has a neutral, ungrounded node 18.

A ground return path downhole sensing unit 20 is coupled to neutral node 18 of AC windings 16. Downhole sensing unit 20 contains measurement circuitry which measures various downhole characteristics and transmits them to the surface unit via power cable 14. Coupled between neutral node 18 and sensing unit 20 is a large inductor 22. Large inductor 22 filters out the AC power in order to prevent interruption of the communication signals transmitted between sensing unit 20 and the surface unit (not shown). In addition, the large inductor 22 protects the sensing unit 20 when a grounded phase creates a high voltage at the neutral node. Power from the power source (not shown) located at the surface is transmitted downhole via power cable 14. Power cable 14 is also be used as a communication means between sensing unit 20 and the surface unit (not shown), which allows the transfer of data relating to downhole conditions.

The prior art method of FIG. 1 is disadvantageous because the inductor (inductor 22) is large and very expensive, restricts the communications bandwidth through the protection circuitry, and can create a source of corrosion. Accordingly, Applicants realize the need to overcome these disadvantages by utilizing active semiconductor circuit components in accordance with the embodiments of the present invention which will now be described.

Figure 2:
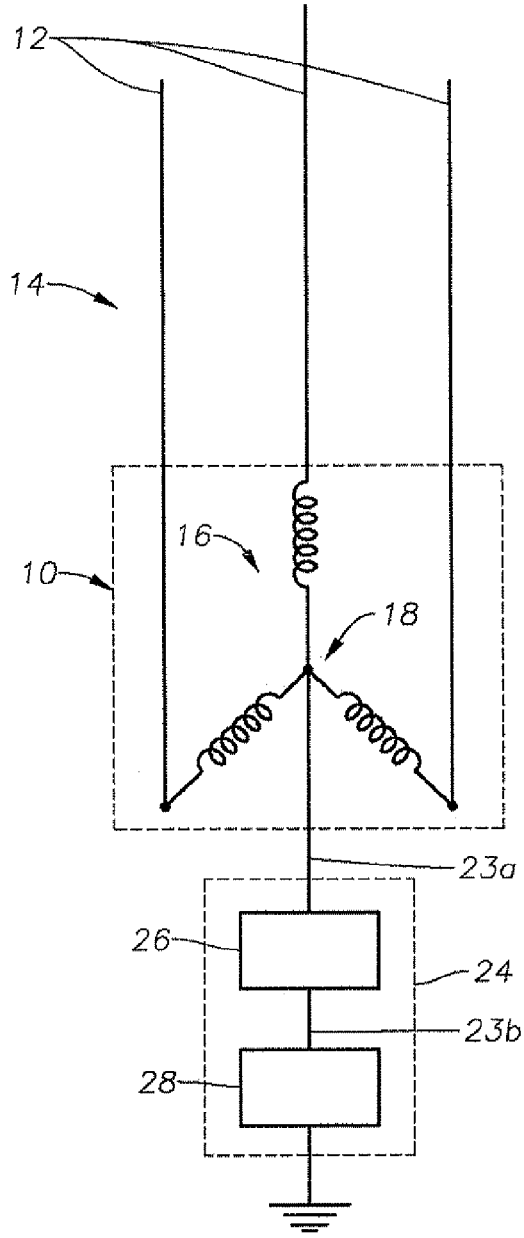
FIGS. 2 and 2A are a block diagram and a partial sectional side view, respectively, of a downhole system according to an exemplary embodiment of the present invention.
Figure 2A:
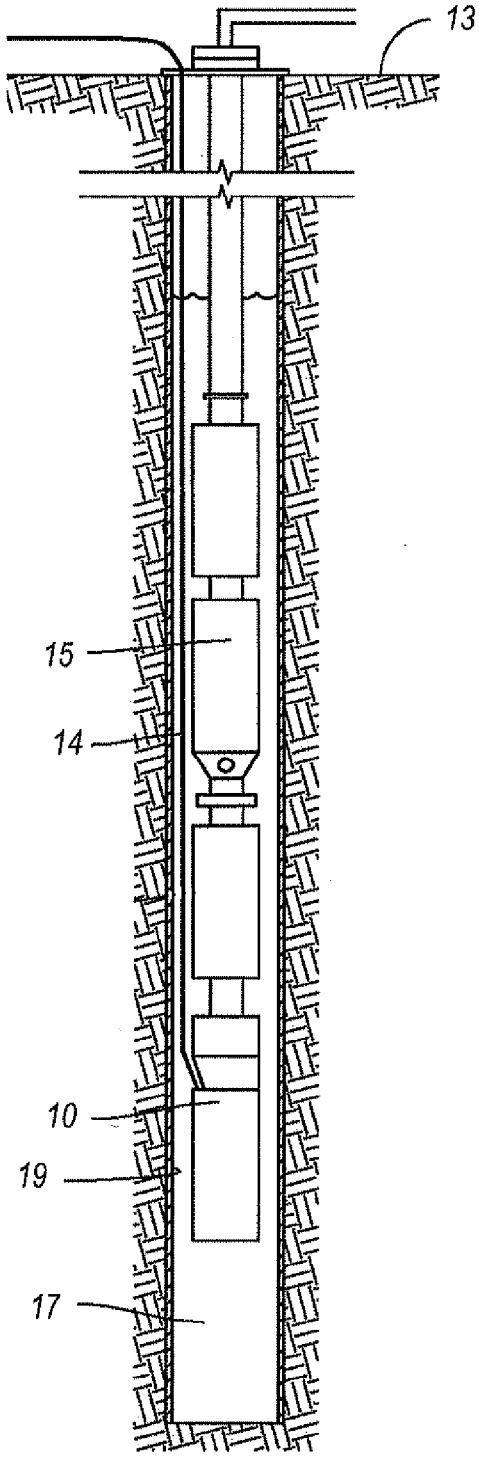

Referring to FIG. 2 and FIG. 2A, an exemplary embodiment of the present invention is illustrated. A pump 15 motor assembly 10 is connected to a three-phase power source (not shown) by means of three conductors 12 located inside power cable 14 which extend downhole 17 from the surface 13. The entire submersible pump 15 installation of FIG. 2A is located downhole 17 inside a standard well casing 19. Motor assembly 10 in FIG. 2 is symbolically shown by a three-phase power AC winding 16, which is Y connected and has a neutral, ungrounded node 18.

A housing 24 is attached to the lower end of pump motor assembly 10. Housing 24 contains an isolation circuit 26, which is electrically coupled to neutral node 18 via conductor 23*a*. Isolation circuit 26 is also electrically coupled to a grounded gauge processor 28 (FIG. 6) via conductor 23*b* in order to transfer data regarding the downhole conditions, such as, for example, temperature and pressure. In operation, gauge processor 28 transmits the digital data back to the surface via a current loop, orthogonal frequency-division multiplexing (OFDM), quadrature phase-shift keying (QPSK), frequency-shift keying (FSK), or other modulation scheme as understood by those skilled in the art. By eliminating the large inductor 22 of the prior art, embodiments of the present invention allow for higher frequency transmissions via current modulation. As understood by those skilled in the art, OFDM, QPSK, and FSK can transmit data to the surface electronics much faster than is possible through a large isolation inductor. An embodiment of the present invention employs FSK frequencies higher than 2.0 KHz to be above the noise band of the ESP system and below 2 MHz to create enough power through the capacitance of the power cable. The FSK can be through conductive signals or via progation through the motor and power cable. Those skilled in the art will recognize that other frequencies and modulations schemes can be included. According to an embodiment of the present invention, in the event of excessive voltage being fed from neutral node 18, isolation circuit 26 will disconnect power from processor 28. According to an alternate embodiment of the present invention, in the event of excessive voltage being fed from neutral node 18, isolation circuit 26 will limit or regulate current to the gauge processor 28.

Isolation circuitry 26 can take the form of any variety of semiconductor circuitries. As is well understood in the art, semiconductors circuits are designed from materials which are neither good conductors of electricity (such as copper) nor good electrical insulators (such as rubber)—hence the term "semi" conductors. The most common semiconductor materials are germanium and silicon. According to design specifications, these materials are then statically modified through a process known as "doping." Doping is a process by which impurities are introduced into the material, which in turn either creates an excess or lack of electrons, thereby encouraging or discouraging electrical conduction, respectively.

In addition to permanent modification through doping, the electrical properties of semiconductors are often dynamically modified by applying electric fields. The ability to control conductivity in semiconductor material, both statically through doping and dynamically through the application of electric fields, has led to the development of transistors. A transistor is a semiconductor device that uses a small amount of voltage or electrical current to control a larger change in voltage or current. Because of its fast response and accuracy, the transistor may be used in a wide variety of digital and analog functions, including switching and voltage regulation.

Moreover, semiconductors make it possible to miniaturize various electronic components. Not only does miniaturization allow the components take up less space, but also results in circuit components which are faster and require less power. As such, in order to take advantage of these characteristics, the present invention employs semiconductor circuitry as a means for voltage suppression and protection, thereby alleviating the disadvantages associated with the large, less efficient, and more expensive inductors.

Gauge processor 28 performs the logic, computational, and downhole measuring functions of the embodiments of the present invention, as understood by those skilled in the art. The circuitry of gauge processor 28 can take various forms and an exemplary embodiment will be discussed later in this disclosure. For example, the circuitry (FIG. 6) of processor 28 could include a power system, current transmitter, and various downhole sensors such as, for example, a pressure transducer, vibration/accelerometer, or temperature sensor. In operation, gauge processor 28 measures the various characteristics of the downhole environment and transmits them back to the surface via conductor 23*b*.

Figure 3A:
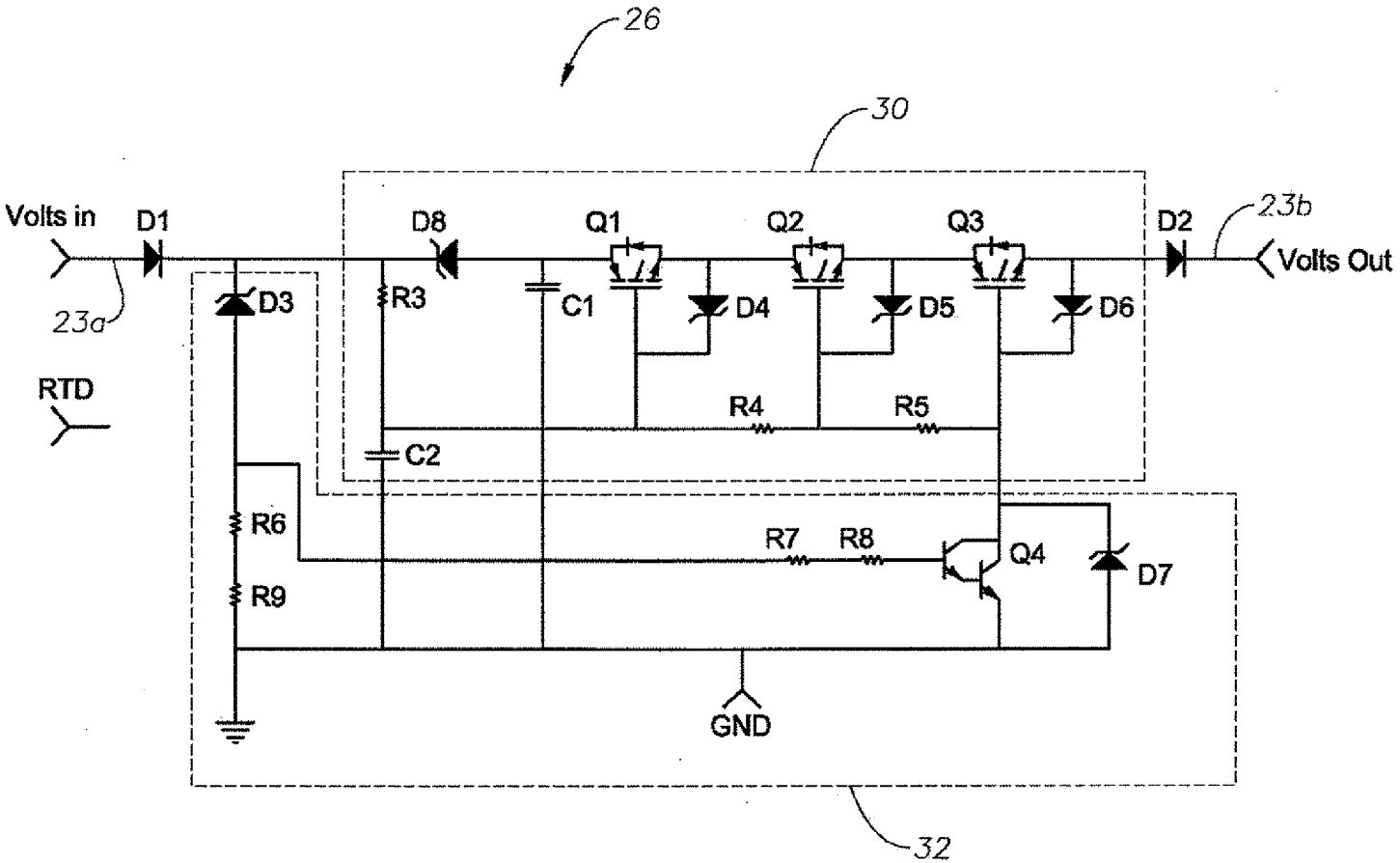
FIG. 3A is a circuit schematic of an isolation circuit according to an exemplary embodiment of the present invention.

Referring to FIG. 3A, an exemplary embodiment of the circuitry for isolation circuit 26 of the present invention is illustrated. Again, the embodiments of the present invention are directed to the use of semiconductor circuitry in protecting downhole electronics. Therefore, the inventors consider this disclosure to encompass any variety of such circuitry and designs. As such, those skilled in the art will appreciate that the operation and design of the present invention is not limited to this disclosure nor the specific circuitry discussed herein, but is susceptible to various changes without departing from the spirit and scope of the invention.

In the exemplary circuit schematic of FIG. 3A, power is applied to isolation circuitry 26 from the neutral Y point 18 via conductor 23*a*. If, during an electrical event, the Y point voltage becomes excessive (generally due to a ground on one of the leads feeding the motor), isolation circuitry 26 will open, thereby protecting gauge circuitry 28. Isolation circuitry 26 includes a diode D1 coupled in series along conductor 23*a* at the input of isolation circuitry 26. Diode D1 is utilized as a block when a megohm meter is connected at the surface, which allows the downhole system to be "megged" (or its insulation checked) in a reverse direction to 5000 VDC (or some other desired voltage). Also, a megohm reading in the forward direction is possible in the event isolation circuitry 26 is open. Isolation circuitry 26 further includes a gate section 30 serving as the main isolation point for the circuit and a trip section 32 which forces gate section 30 open when the voltage applied to the circuit exceeds a specified threshold.

In the exemplary embodiment of FIG. 3A, gate section 30 includes three insulated gate bi-polar transistors ("IGBT") Q1, Q2, and Q3 which are coupled in series to insure the voltage is divided between them. In other embodiments of the present invention, the gate section can comprise a different number of IGBT devices, as understood by those skilled in the art. That is, the isolation circuit comprises a plurality of isolated gate bi-polar transistors, according to embodiments of the present invention. The IGBT devices combine the simple gate drive characteristics of the MOSFET with the high current and low saturation voltage capability of bipolar transistors by combining an isolated gate for the control input, and a bipolar power transistor as a switch, in a single device.

In this example embodiment, each IGBT device (Q1, Q2, and Q3) is rated at 1200 and the maximum voltage is 3000 VAC. Resistors R3, R4, and R5 are coupled at the base of each IGBT Q1, Q2, and Q3 for the purpose of biasing and power dissipation. Zener diodes D4, D5, and D6 are coupled in parallel, in the reverse direction, with IGBT Q1, Q2, and Q3, respectively, in order to protect IGBT Q1, Q2, and Q3 from power surges being sent downhole from the circuit input. Another diode D2 is coupled in series behind gate section 30 (between isolation circuit 26 and gauge processor 28) in order to prevent power surges from being sent back into isolation circuitry 26 from gauge circuitry 28. More or different IGBT devices and isolation circuitry can be utilized as protection from a higher voltage, as understood by those skilled in the art.

Figure 3B:
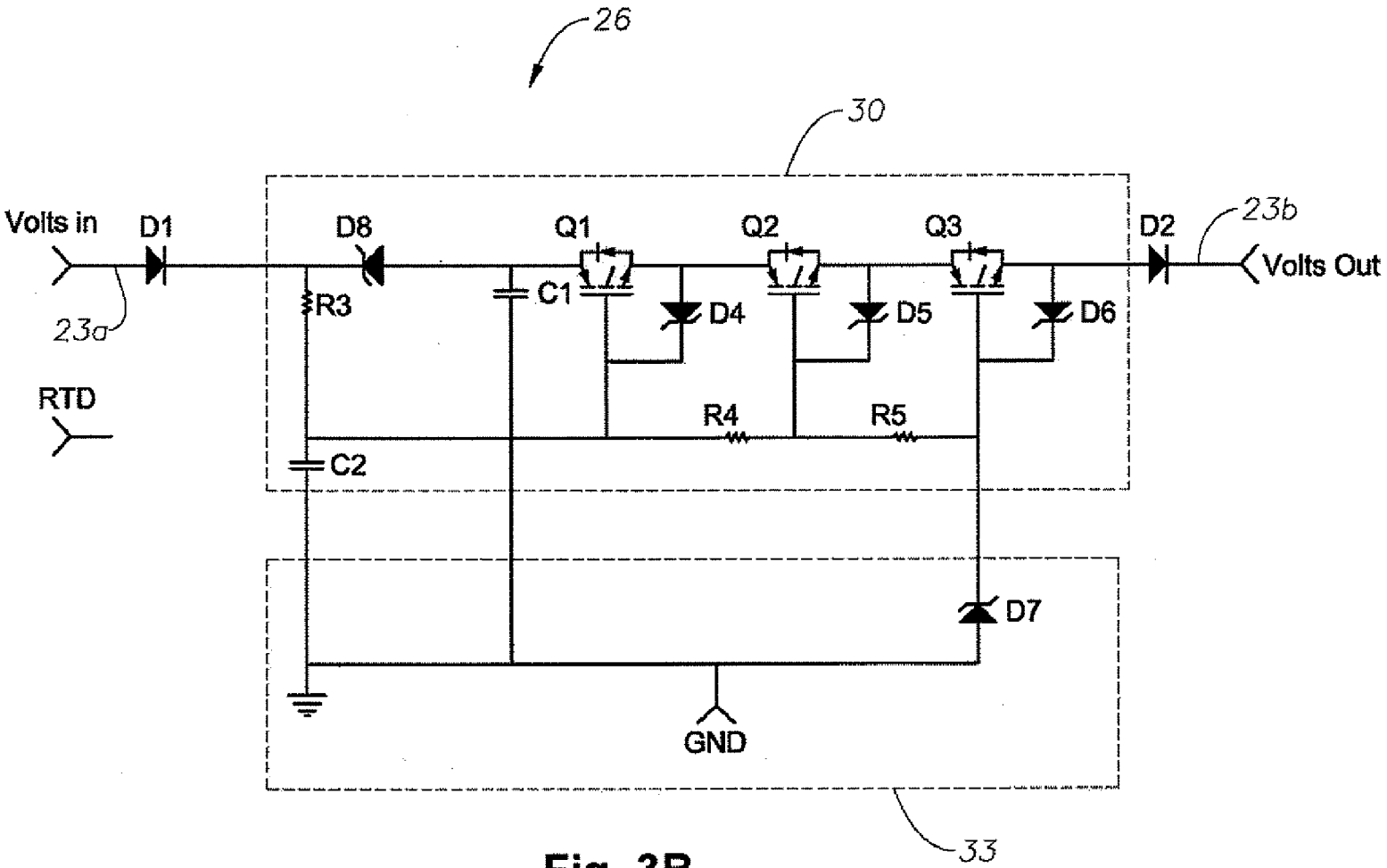
FIG. 3B is another circuit schematic of an isolation circuit according to an exemplary embodiment of the present invention.

Further referring to the exemplary embodiment of FIG. 3A, trip section 32 includes zener diode D3 coupled in series with diode D1 in the reverse direction (cathode terminal of zener diode D3 is coupled to cathode terminal of diode D1) in order to set the bias voltage for isolation circuitry 26. Resistors R7 and R8 and resistors R6 and R9 are coupled in series with zener diode D3 and in parallel with transistor assembly Q4 respectively, for power dissipation purposes. (Transistor assembly Q4 is a Darlington transistor, which combines two bipolar transistors in tandem within a single device so that the current amplified by the first is amplified further by the second transistor.) The base of transistor assembly Q4 is coupled in series behind resistors R7 and R8. The collector terminal of transistor assembly Q4 is coupled to the base of IGBTs Q1, Q2, and Q3, and acts as the primary "trip" point for the circuitry. Another zener diode D7 is coupled between the collector terminal of transistor assembly Q4 and ground in order to regulate current flow into the collector terminal of transistor assembly Q4. An alternate embodiment is to ground the anode of zener diode D7, as illustrated in FIG. 3B, creating a limiter, or regulator, to conductor 23*b*, as understood by those skilled in the art.

In normal operation, zener diodes D3 does not conduct and the resistor chain R3, R4, and R5 will form a divider which turns on the gate section chain Q1, Q2, and Q3 using the voltage received from the surface via conductor 23*a*. In the event the voltage increases to the point where zener diode D3 begins to conduct, the current flows through zener diode D3, thus causing transistor assembly Q4 to activate. Once transistor assembly Q4 is activated, gate section chain Q1, Q2, and Q3 is opened, or tripped, thereby preventing any power flow to gauge circuitry 28 via conductor 23*b*.

In another exemplary embodiment, isolation circuitry 26 could also include additional circuitry or alternative circuit designs. For example, a diode could be coupled across the emitter and collector terminals of transistor assembly Q4 in order to protect transistor assembly Q4 from voltage surges entering the circuit via conductor 23*a*. Also, capacitors could be coupled at various locations in the circuit in order to filter noise created by the diodes and elsewhere on the system. In another exemplary embodiment, isolation circuitry 26 may be potted with a high thermal conduction epoxy. The epoxy isolates the circuitry from electrical arching, protects the circuitry from particulates in the oil, and provides thermal conduction for the resistors and components.

In yet another embodiment, the isolation circuitry can include a small inductor before diode D1 to further eliminate spikes and ESP motor noise. As understood by those skilled in the art, this inductor may be much lower voltage due to the voltage drop across the semiconductor circuitry.

Figure 4:
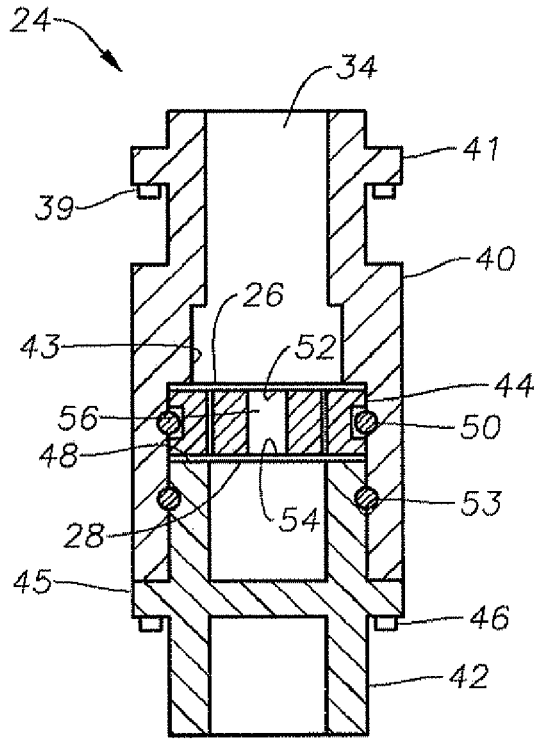
FIG. 4 is a sectional view of a downhole housing according to an embodiment of the present invention.

Referring to FIG. 4, an exemplary embodiment of housing 24 of the present invention is illustrated. Housing 24 includes a head 40, base 42, and a manifold plate 44 which fits within the assemblies. The head assembly 40 and base assembly 42, together with manifold plate 44, form housing 24. Housing 24 is tubular shaped having a hollow interior 34. Head 40 is attached to motor assembly 10 by way of thread and bolt assembly 39 which is located on flange 41 that extends around the outside diameter of head 40. Head 40 is attached to base 42 through another bolt and thread assembly 46 located on a flange 45 that extends around the outside diameter of base 42. Base 42 can be closed or other equipment can be attached to its lower end. Conductor 23*a* extends through hollow interior 34 from motor assembly 10 in order to feed power to isolation circuit 26 and gauge processor 28.

Base 42 is of a diameter which allows it to fit snugly inside head 40. Extending around the inside hollow interior of head 40 is a shoulder 43. As base 42 is moved into place inside the diameter of head 40, manifold plate 44 rests between upper end 48 of base 42 and shoulder 43 of head 40. As such, the axis of manifold plate 44 is perpendicular to the axis of housing 24. In an alternative embodiment, manifold plate 44 is mounted inside its own individual housing (not shown). An o-ring 50 extends around the outside diameter of manifold plate 44 in order to form a seal between the inside surface of head 40 and manifold plate 44.

Figure 5:
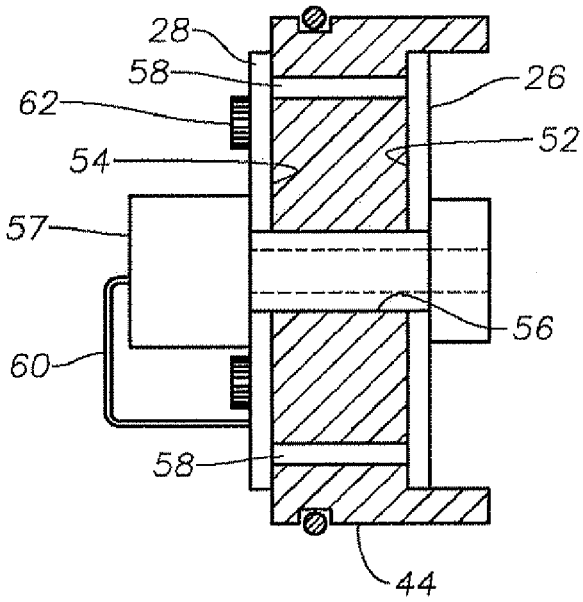
FIG. 5 is a sectional view of a manifold plate according to an embodiment of the present invention.

Referring to FIGS. 4 and 5, an exemplary embodiment of manifold plate 44 of the present invention will now be described. Manifold plate 44 forms the mounting for isolation circuit 26 and gauge processor 28. Isolation circuit 26 is contained on a circuit board on the upper surface 52 of manifold plate 44, while gauge processor 28 is contained on a circuit board on the lower surface 54 of manifold plate 44. As such, once the housing 24 is assembled, isolation circuit 26 will be mounted inside the motor oil of motor assembly 10 on the upper surface 52 of manifold plate 44. Also, as illustrated, isolation circuit 26 and gauge processor 28 are mounted parallel to each other and perpendicular to the axis of housing 24. In other embodiments of the present invention, the isolation circuit 26 and gauge processor 28 may be mounted in other orientations within the housing. A first o-ring 50 provides a sealant to protect gauge processor 28 from oil and debris. Likewise, a second o-ring 53 forms a seal between the inside surface of head 40 and the outside surface of the base 42. The pressure on the upper side of o-ring 50 will be at the motor oil pressure, which is substantially equal to the hydrostatic pressure in the well. The pressure on the lower side is at atmospheric levels. As understood by those skilled in the art, nitrogen or an inert gas can be used on the lower side to protect the electronics. In addition, isolation circuit 26 is potted for protection from particulates in the oil.

A pressure port 56 extends through manifold plate 44 from upper surface 52 to lower surface 54 in order to allow gauge processor 28 access to the oil pressure for measurements and testing received from pressure sensor 57 via wire 60. Pressure port 56 contains threads which allow pressure sensor 57 to be screwed into port 56. Pressure port 56 also contains a seal (not shown) in order to prevent leakage of oil and debris. Sealed feedthroughs 58 are also located through manifold plate 44 extending from upper surface 52 to lower surface 54 in order to allow power, as well as other data (sent via wires), to be feed from conductor 23 a to isolation circuit 26 and then on to gauge processor 28.

A vibration sensor 62 (e.g., accelerometer) can also be mounted to the circuit board of gauge processor 28 in order to detect vibrations. As discussed previously, manifold plate 44, as well as the circuit boards of gauge processor 28 and isolation circuit 26, is perpendicular to the axis of housing 24. As such, vibration sensor 62 can detect vibrations in the plane perpendicular to the axis of housing 24.

Figure 6:
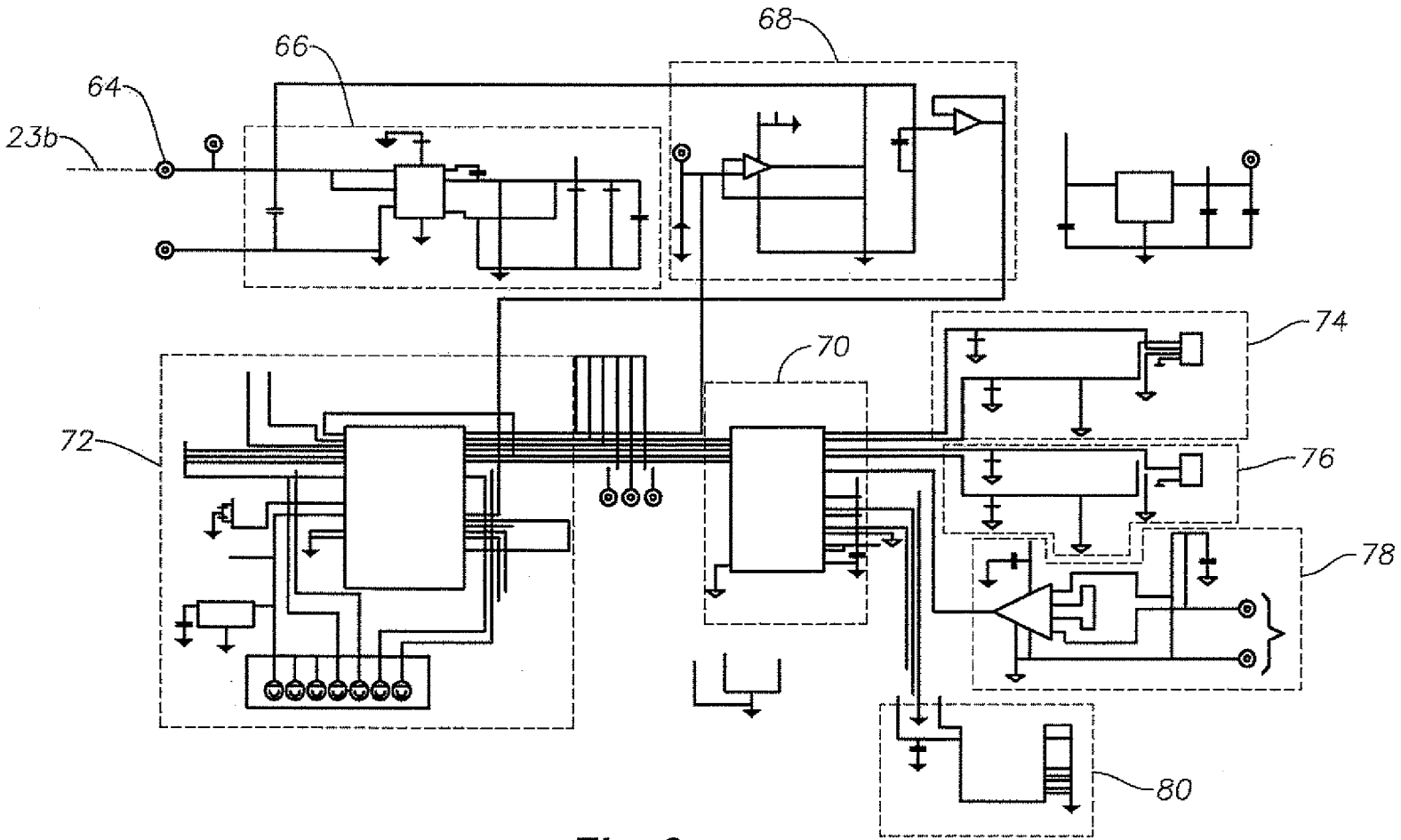
FIG. 6 is a circuit schematic of a gauge processor according to an embodiment of the present invention.

Referring to FIG. 6, an exemplary embodiment of the circuitry of gauge processor 28 will now be described. Conductor 23*b* provides voltage into input 64. A switching regulator 66 is coupled in series to input 23*b*, which is used as an internal control circuit that switches power transistors (such as MOSFETs) rapidly on and off in order to stabilize and reduce the output voltage or current supplied to the circuit to a selected level. Alternately, a constant current or shunt regulator can be used instead of the switching regulator 66, as understood by those skilled in the art. A transmitter 68 is also coupled in series to input 64 and is used to transmit measurements obtained by gauge processor 28 over the system current loop. Coupled to transmitter 68 is an analog to digital converter 70 ("A/D converter"), which is used to convert the analog measurement data obtained from the sensors 74,76 of gauge processor 28 from analog to digital form before they are transmitted by transmitter 68. A programmable CPU/processor 72 is coupled to transmitter 68 and A/D converter 70 in order to handle all processing and circuit logic of gauge processor 28.

A number of sensors are coupled to A/D converter 70 in order to obtain the necessary measurements of the downhole environment. As illustrated in the exemplary embodiment of FIG. 6, one of the pressure sensors 74,76 is used to measure the atmospheric pressure surrounding gauge processor 28, while the other is used to measure the oil pressure of the motor environment. Temperature sensor 78 is coupled to A/D converter 70 and is used to obtain temperature measurements of the motor oil. Lastly, a vibration sensor 80 is coupled to A/D converter 70 in order to obtain vibration measurements of the downhole environment. Each sensor transmits its respective measurements as an analog signal, which must be converted by A/D converter 70 before being sent to processor 72 and then transmitted back to the surface via transmitter 68. Each sensor is mounted onto the PC board of gauge processor 28, however, in an alternative embodiment, any or all of the sensors can be located elsewhere within the downhole system.

It is important to note that while embodiments of the present invention have been described in the context of a fully functional isolation circuit and related methods, those skilled in the art will appreciate that the mechanism of the present invention and/or aspects thereof are capable of being distributed in the form of a computer readable medium of instructions in a variety of forms for execution on a processor, processors, or the like, and that the present invention applies equally regardless of the particular type of signal bearing media used to actually carry out the distribution. Examples of computer readable media include but are not limited to: non-volatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, and other newer types of memories, and transmission type media such as digital and analog communication links. For example, such media can include both operating instructions and/or instructions related to the circuitry described above.

While this invention has been shown in only one of its forms, it should be apparent to those skilled in the art that it is not so limited but is susceptible to various changes without departing from the spirit and scope of the invention. For example, various circuitry, circuit components, and/or circuit designs can be utilized to achieve the function of the gauge circuitry. As such, those skilled in the art will appreciate that the operation and design of the present invention is not limited to this disclosure nor the specific circuitry discussed herein, but is susceptible to various changes without departing from the spirit and scope of the invention. In the drawings and specification, there have been disclosed illustrative embodiments of the invention and, although specific terms are employed, they are used in a generic and descriptive sense only and not for the purpose of limitation.

We claim:

1. A well pump assembly, the pump assembly comprising:

a motor;

a housing mounted to the motor;

a gauge circuit located in the housing, the gauge circuit being positioned to monitor at least one physical parameter of an environment of the motor; and an isolation circuit located within the housing and being coupled to the motor and the gauge circuit, the isolation circuit comprising semiconductor elements including circuitry being positioned to detect a high voltage event and to protect the gauge circuit from the high voltage event.

2. A pump assembly of claim 1, wherein the isolation circuit comprises a plurality of isolated gate bi-polar transistors.

3. A pump assembly of claim 1, wherein the gauge circuit includes a regulator being positioned to regulate power supplied from the isolation circuit, the regulator being one or more of the following: a switching regulator; a constant current regulator; and a shunt regulator.

4. A pump assembly of claim 1, wherein the housing comprises:

a circular manifold plate having a seal on an outer diameter of the manifold plate that seals to an inner surface of the housing, the manifold plate further comprising:

an upper surface, wherein the isolation circuit is mounted to the upper surface, a lower surface, wherein the gauge circuit is attached to the lower surface, and at least one communication port extending between the upper and lower surfaces.

5. A pump assembly of claim 1, wherein the gauge circuit includes a PC board mounted perpendicular to an axis of the housing and an accelerometer mounted in a plane perpendicular to the axis of the housing.

6. A pump assembly of claim 1, wherein the gauge circuit includes a gauge mounted inside the motor.

7. A pump assembly of claim 1, wherein the isolation circuit is potted, thermally and electrically isolated, and located within motor oil of the motor.

8. A pump assembly of claim 1, wherein the isolation circuit is mounted within a gauge chamber of the housing with high voltage feedthroughs.

9. A well pump assembly, comprising:

a motor;

a housing mounted to the motor, the housing comprising:

a head having a hollow interior and a shoulder, the head being mounted to the motor so that, in operation, oil from the motor fills the interior of the head, a base having an outside diameter to fit snugly inside the head and being attached to the head, and a manifold plate located between an upper end of the base and the shoulder of the head so that the axis of the manifold plate is perpendicular to the axis of housing, the manifold plate having a lower surface and an upper surface;

a gauge circuit mounted to the lower surface of the manifold plate; and an isolation circuit attached to the upper surface of the manifold plate so that the isolation circuit is mounted inside the interior of the head.

10. A pump assembly of claim 9, wherein the head has a first flange being positioned to attach to the motor through a first bolt and thread assembly, and wherein the base is attached to the head through a second bolt and thread assembly located on a second flange that extends around an outside diameter of the base.

11. A pump assembly of claim 9, further comprising:

a seal ring extended around an outside diameter of the manifold plate in order to form a seal between an inside surface of the head and the manifold plate.

12. A pump assembly of claim 9, wherein the isolation circuit is potted, and thermally and electrically isolated.

13. A pump assembly of claim 9, wherein the isolation circuit comprises a plurality of isolated gate bi-polar transistors.

14. A method of protecting a downhole gauge circuit of a well pump assembly from excessive voltage, the method comprising:

monitoring a physical parameter of an environment of a motor assembly of a well pump assembly via a gauge circuit;

detecting an excessive voltage on a neutral node of a three-phase power winding associated with the motor assembly of the well pump assembly via active semiconductor circuitry; and limiting electrical conduction via active semiconductor circuitry to the gauge circuit of the well pump assembly when excessive voltage is detected so that the gauge circuit is protected from the excessive voltage.

15. A method of claim 14, wherein the step of limiting electrical conduction via active semiconductor circuitry to the gauge circuit involves disconnecting the power from the gauge circuit by forcing an open circuit.

16. A method of claim 14, wherein the step of limiting electrical conduction via active semiconductor circuitry to the gauge circuit involves a regulator being positioned to regulate power supplied to the gauge circuit, the regulator being one or more of the following: a switching regulator; a constant current regulator; and a shunt regulator.

17. A method of claim 14, wherein the active semiconductor circuitry in the step of detecting an excessive voltage comprises a plurality of isolated gate bi-polar transistors.

* * * * *